US005150955A

United States Patent [19]

Devaney, Jr. et al.

[11] Patent Number: 5,150,955

[45] Date of Patent: Sep. 29, 1992

[54] DRYING APPARATUS

[75] Inventors: Mark J. Devaney, Jr.; Lee F. Frank, both of Rochester; Jeffrey L. Helfer, Webster; Haribhajan S. Kocher, Penfield; Paul W. Wagner, Holley, all of N.Y.

[73] Assignee: Eastman Kodak Company, Rochester, N.Y.

[21] Appl. No.: 785,899

[22] Filed: Oct. 31, 1991

Related U.S. Application Data

[63] Continuation of Ser. No. 633,495, Dec. 28, 1990, abandoned.

[51] Int. Cl.[5] ..... G03D 3/08

[52] U.S. Cl. ..... 354/321; 34/156

[58] Field of Search ..... 354/321; 34/1, 155, 34/156, 160

[56] References Cited

U.S. PATENT DOCUMENTS

| | | | |
|---|---|---|---|
| 2,492,974 | 1/1950 | Dungler | 34/156 |
| 3,041,739 | 7/1962 | Meir-Windhorst | 34/156 |
| 3,324,570 | 6/1967 | Flaith et al. | 34/156 |
| 3,417,484 | 12/1968 | McCarthy | 34/156 |
| 3,662,476 | 5/1972 | Capizzi | 34/156 |
| 3,672,066 | 6/1972 | Stephansen | 34/1 |
| 3,805,409 | 4/1974 | Sato et al. | 34/160 |
| 4,135,312 | 1/1979 | Hope et al. | 34/160 |
| 4,290,210 | 9/1981 | Johansson | 34/155 |
| 4,295,284 | 10/1981 | Witkin | 34/155 |
| 4,467,537 | 8/1984 | Trotscher | 34/155 |
| 4,472,888 | 9/1984 | Spiller | 34/156 |
| 4,594,795 | 6/1986 | Stephansen | 34/68 |
| 4,901,449 | 2/1990 | Wimberger | 34/156 |

*Primary Examiner*—L. T. Hix
*Assistant Examiner*—D. Rutledge
*Attorney, Agent, or Firm*—James A. Smith; G. Herman Childress

[57] ABSTRACT

Apparatus for drying webs of light sensitive material comprises means defining a channel for receiving a web, a plurality of elongated spaced injection slits for applying drying fluid to opposite sides of the web, and a plurality of elongated spaced evacuation slits for evacuating drying fluid from opposite sides of the web. The injection and evacuation slits are substantially parallel and angularly oriented relative to the longitudinal axis of the web.

17 Claims, 5 Drawing Sheets

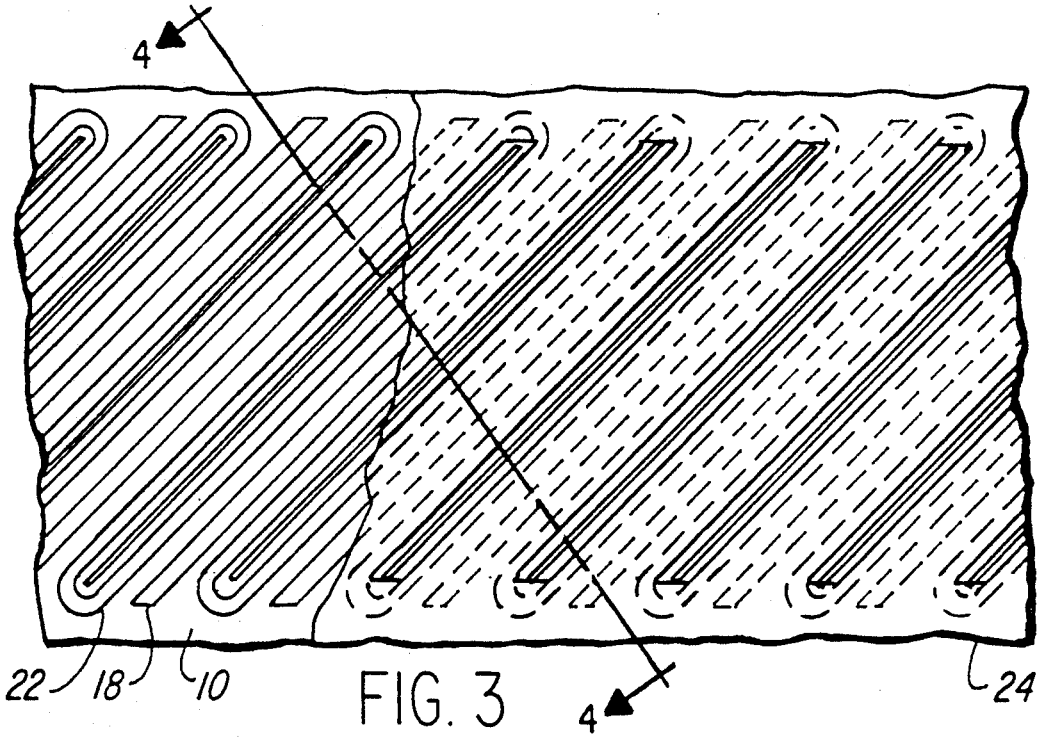
FIG. 3
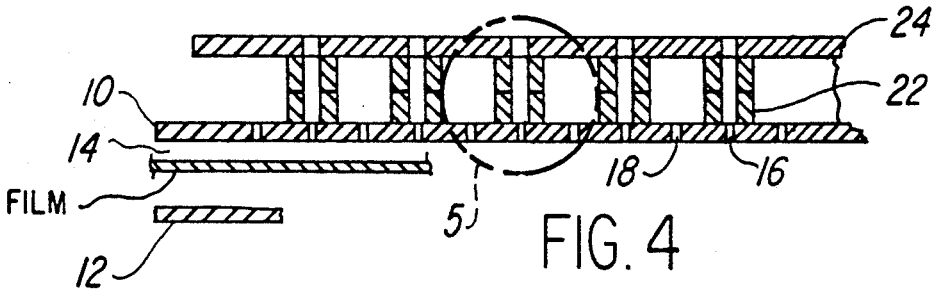
FIG. 4
FIG. 5
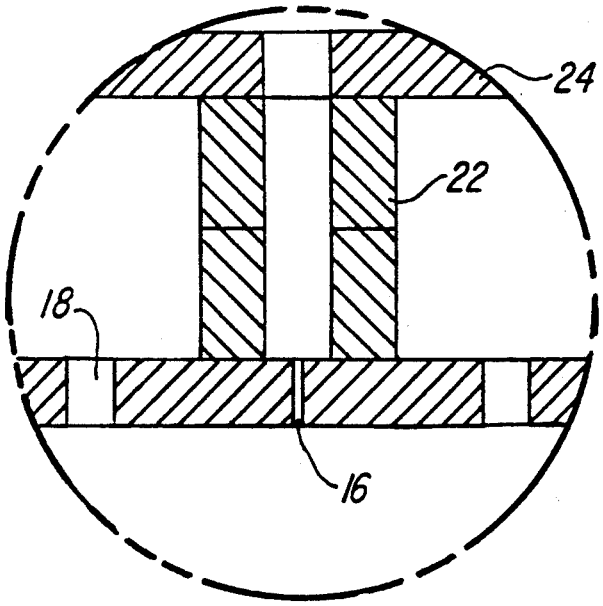

DRYING APPARATUS

CROSS REFERENCE TO RELATED APPLICATION

Reference is made to commonly assigned copending application Ser. No. 07/633,505 entitled "Apparatus for Enhancing Heat and Mass Transfer In a Fluid Medium" filed and concurrently herewith by Mark Joseph Devaney, Jr., Lee F. Frank, Jeffrey L. Helfer, Haribhajan S. Kocher and Paul W. Wagner. The disclosure of such application is incorporated herein by reference.

1. Technical Field

This invention relates to apparatus for subjecting web or sheet material to treatment with fluids and, more particularly, to apparatus for drying light sensitive material such as photographic film or paper during processing.

2. Background Art

Conventional film and paper drying is typically done by moving the web on a series of rollers through a heated chamber. A fan or blower is used to move air over a resistance heater, around the film and out of the processor into the surrounding work area. Higher volume/higher speed units use an impingement jet dryer in which a blower pressurizes a plenum with heated air. Slots cut into the plenum allow streams of air to blow against the surface of the film. These slots are typically an inch or so from the film to allow the stream to spread over the surface of the film. In both cases large amounts of costly heated air must be vented to the environment heating the surrounding room. In addition heated air escapes within the processing solutions.

The above inefficiencies can be explained as follows:

Conventional film (or paper) drying devices do not provide a sufficient level of agitation at the film-fluid interface. As a result, a region of reduced temperature, is created in the layer of air which exists at the film surface during the drying process of the processor. This layer is the thermal boundary layer.

Analysis and experimental measurements of conventional dryers indicate that boundary layers exist which are thick enough so as to become the drying rate limiting parameter. More specifically, the transfer of heat energy through the thermal boundary layers occurs more slowly than transfer through the film itself. This condition results in low drying speeds, excessively long drying paths and increased size of the dryer. Drying temperatures need to be excessively high to maintain reasonable film drying rates resulting in inefficient utilization of thermal energy.

As disclosed in application Ser. No. 07,633,505 uniformity of heat (or mass) transfer to the top and bottom surfaces of a film transported through a channel can be uniformly achieved by establishing laminar flow of fluid on opposite sides of the film. By minimizing the length of the fluid flow paths and using reasonably high fluid velocities in the laminar flow regions of the flow paths, the effectiveness of the chemical or heat transfer process is substantially enhanced as disclosed in application Ser. No. 07,633,505 incorporated herein by reference. In addition, the flow streams support the film out of contact with the channel surfaces to provide film positional stability. This reduces mechanical antifacts (such as scratches) due to film contacting channel surfaces.

In the apparatus disclosed in application Ser. No. 07,633,505 fluid is injected into and evacuated from the channel by means of juxtaposed injection slits and evacuated by means of juxtaposed evacuation slits. The slits extend transversely of the film axis in substantially perpendicular relationship therewith. Each juxtaposed path of injection slits is positioned between two pair of juxtaposed evacuation slits to cause fluid to flow in opposite directions from each injection site to adjacent evacuation sites.

While the apparatus disclosed in this application achieves mass and heat transfer that is clearly superior than prior art apparatus while supporting a web out of contact with channel surfaces, it has been found that some instability of the web can occur which results in web vibrations particularly when such apparatus is used to dry web material with air. Such conditions do not effect the performance of the disclosed apparatus, but provide opportunities to further enhance the results achieved.

Because of the alternating arrangement of injection and evacuation sites, there are also alternating regions of high and low pressure in the film channel. The pressure of the fluid on each side of the web is maximum at the injection sites and minimum at the evacuation sites. As a result, the web has maximum support at the injection sites and minimum support at the evacuation sites. If the injection and evacuation sites extend perpendicular to the film axis, then transversely extending low pressure regions exist which provide minimal support to the web and render it subject to displacement by gravity. Because of the alternating arrangement of these high and low pressure regions, the web can even vibrate or oscillate even though it remains out of contact with the surfaces of the channel.

The condition described is most apparent when transporting the leading or trailing end of a web through the channel. Because the end is free, it can act as a cantilever beam and is even more affected by the high and low pressure zones. The pressure forces can even produce web end lift particularly when the treating fluid is air. These effects are more pronounced when drying large sheets of material such as photographic film.

DISCLOSURE OF THE INVENTION

In accordance with the invention the condition described above is minimized by arranging the injection and evacuation slits at an angle relative to the longitudinal axis of the web. This causes the high pressure and low pressure regions to extend angularly across the film. With this arrangement each injection opening produces a fluid stream having one flow component angled relative to the longitudinal axis of the web in the direction of web travel and a second flow component angled relative to the longitudinal axis opposite to the direction of web travel. The components in the direction of web travel minimize lift of the web by the treating fluid and have a stabilizing effect. Also, the pressure of the fluid emitted from the angled openings tends to produce pressure corrugations in the web extending angularly to the web longitudinal axis. Such corrugations tend to reinforce the web and make it more resistant to bending and less subject to vibration.

BRIEF DESCRIPTION OF THE DRAWINGS

Other objects and advantages will become apparent from following description taken in connection with the attached drawings wherein:

FIG. 3 is a plan view of the manifold arrangement shown in FIG. 1 with cover plate partially cutaway;

FIG. 4 is a section taken along the line 4—4 of FIG. 3;

FIG. 5 is an enlarged detail of the area 5 of FIG. 4;

MODE OF CARRYING OUT THE INVENTION

Figure 1:
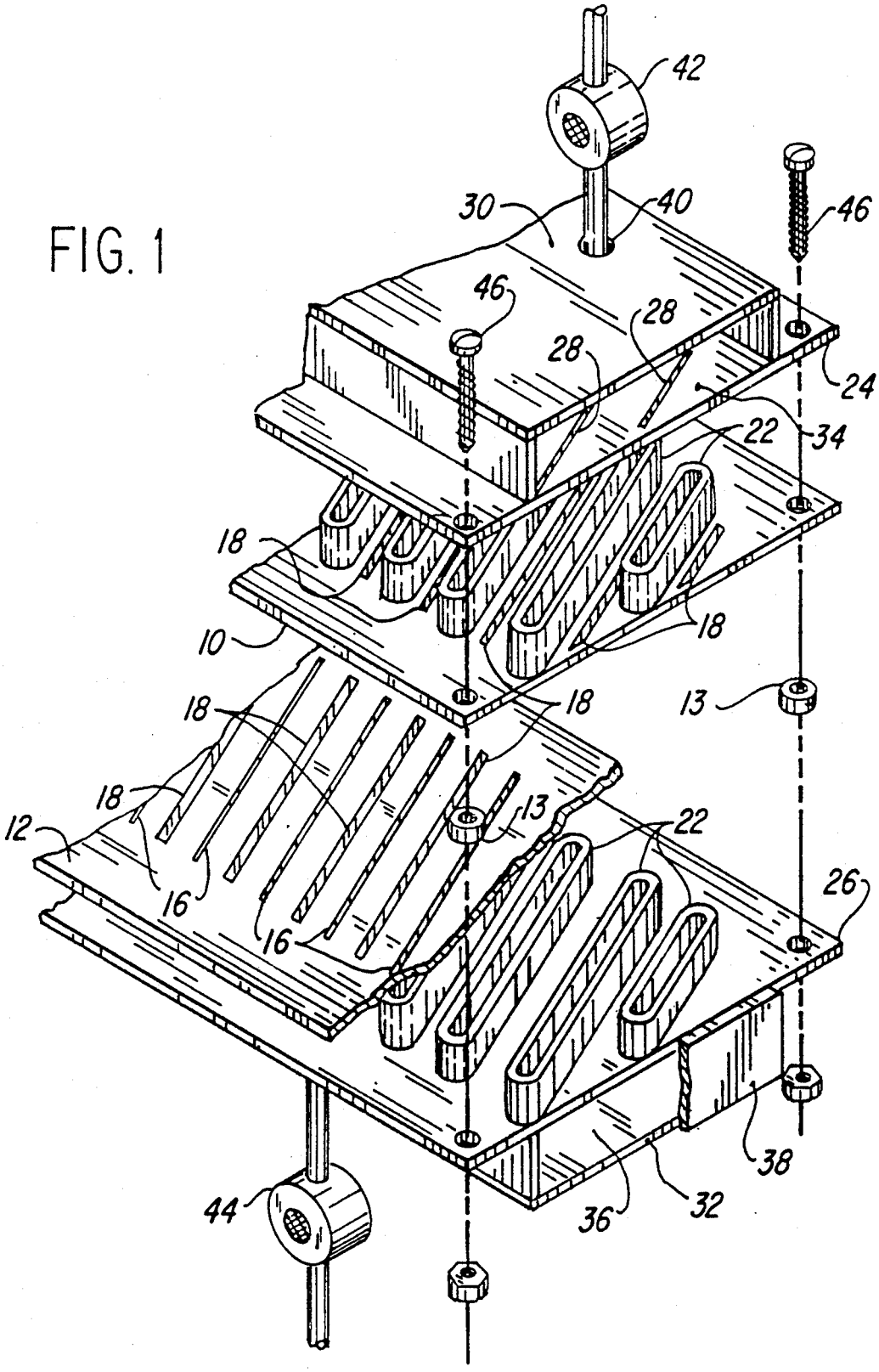
FIG. 1 is an exploded perspective view of a portion of a preferred embodiment of a film dryer in accordance with the invention.
Figure 2:
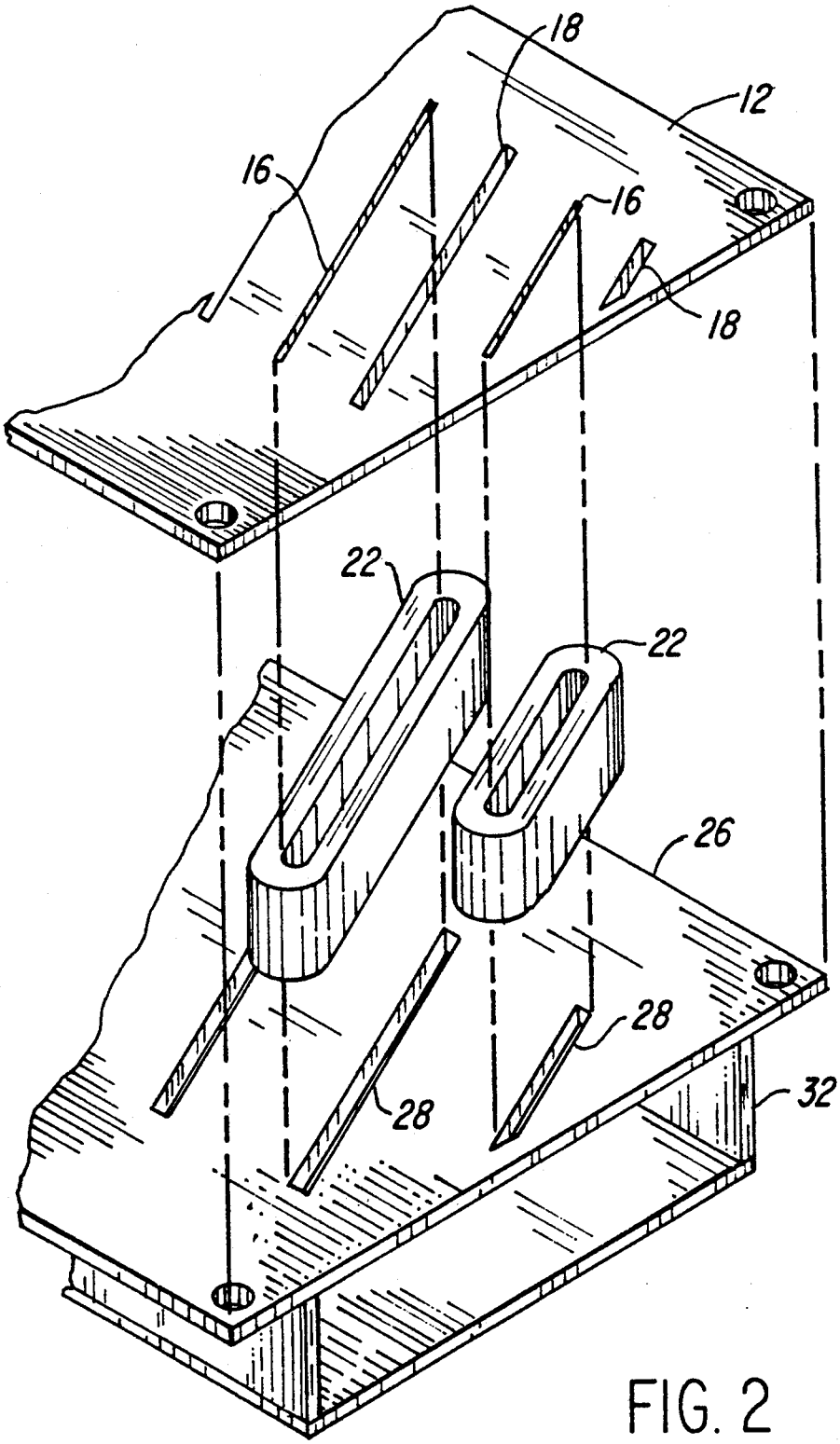
FIG. 2 is a view similar to FIG. 1 with parts omitted to show the construction in more detail.

Referring to FIGS. 1 and 2 of the drawings, there is shown a pair of spaced plates 10, 12 adapted to be clamped together and separated by spacers 13 to define a channel 14 (FIG. 4) therebetween for receiving a web W, e.g. photographic film.. The plates 10, 12 each have a plurality of elongated spaced fluid injection openings or slits 16 and a plurality of elongated spaced fluid evacuation openings or slits 18. When the plates are clamped together, the openings 16 in plates 10 and 12 will be aligned and in juxtaposed relationship. Similarly, openings 18 in plates 10 and 12 will be in aligned juxtaposed relationship. The openings 16 and 18 alternate so that each pair of juxtaposed injection openings is between two pairs of juxtaposed evacuation openings. As will be discussed in more detail below, all of the openings 16 and 18 are positioned in parallel relationship and define an axis having an angular relationship with the longitudinal axis of the film. This angular relationship of the openings with the longitudinal axis of the film is most clearly apparent from FIG. 6. While an angle of 45 degrees is preferred enhanced positional stability can be achieved with angles as small as 15 degrees and as large as 90 degrees.

A plurality of elongated hollow spacer members 22 are fixed to the plates 10 and 12 with the hollow interiors of the members in communication with the openings 16. A pair of plates 24, 26 are positioned over the members 22 on the sides opposite from the plates 10, 12 respectively. Slots 28 in the plates 24, 26 communicate with interiors of members 22 to supply fluid to the slots 16 via the interiors of members 22.

A pair of housings 30, 32 are fixed to the plates 24, 26, respectively, to provide a manifold chambers 34 and 36 for supplying air to the openings 28. The ends of the chambers 34, 36 may be sealed by end plates 38, one of which is depicted in FIG. 1. Each housing 30, 32 is provided with an air inlet opening 40. Blowers 42, 44 (FIG. 1) supply air under pressure to each inlet.

It will be obvious that each of the plates 24, 26 may be formed integrally with its associated housing and thus comprises a wall of such housing to thus define a housing means having chambers for supplying fluid to the channel 14.

To complete the assembly bolts 46 which extend through holes in the plates and through the spacers 13 (FIG. 1), clamp the plates 10, 12, 24, 26 together. When so assembled, the channel 14 between plates 10, 12 will have a length equal to the thickness of spacers 13.

In operation of the dryer, fluid under pressure (in this case, air) will be supplied to the chambers 34 and 36 by blowers 42, 44 to pressurize the chambers. From chambers 34, 36, air will flow through slits 28 and the interior of members 22 to slits 16. Air will be injected through slits 16 into channel 14 on opposite sides of the film to create regions of air under pressure on opposite sides of the film. Air will flow from the slits 16 to the adjacent evacuation slits 18 as indicated by the arrows in FIG. 6 and be subsequently evacuated into the space between plates 10, 24 and between plates 12, 23.

The slits 16 are preferably sized and spaced from the slits 18 by a distance such that the air is evacuated when the boundary layer reaches a thickness rendering the heat transfer between the air and film inefficient. More specifically, the heat transfer process is enhanced by minimizing the length of the flow path from an injection slit to an evacuation slit to minimize the distance over which the boundary layer is permitted to develop and by minimizing the rate at which the boundary layer is allowed to grow. the latter is achieved by using reasonably high fluid velocities in the laminar flow region. These concepts are disclosed and claimed in copending application Ser. No. 07,633,505, cross referenced above and incorporated herein by reference. further disclosure in this application is deemed unnecessary.

Figure 8:
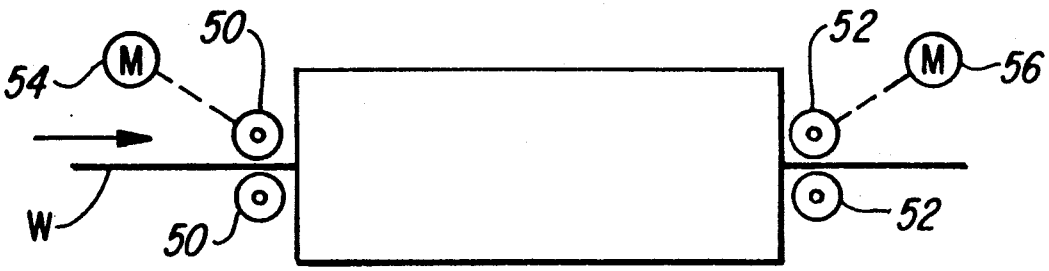
FIG. 8 is side view of the assembled dryer and film transport rollers.

Referring now to FIG. 8 which is a side view of the assembled dryer, the web W is transported through the processor by two pairs of nip rollers 50 and 52 adjacent the entrance and exit of the channel 14 respectively. Such rollers may be driven by motors 54, 56 as indicated. When drying webs in sheet form, the rollers would be spaced by a distance less than the length of the sheet so that the sheet is gripped by the exit rollers before it leaves the entrance rollers.

Figure 6:
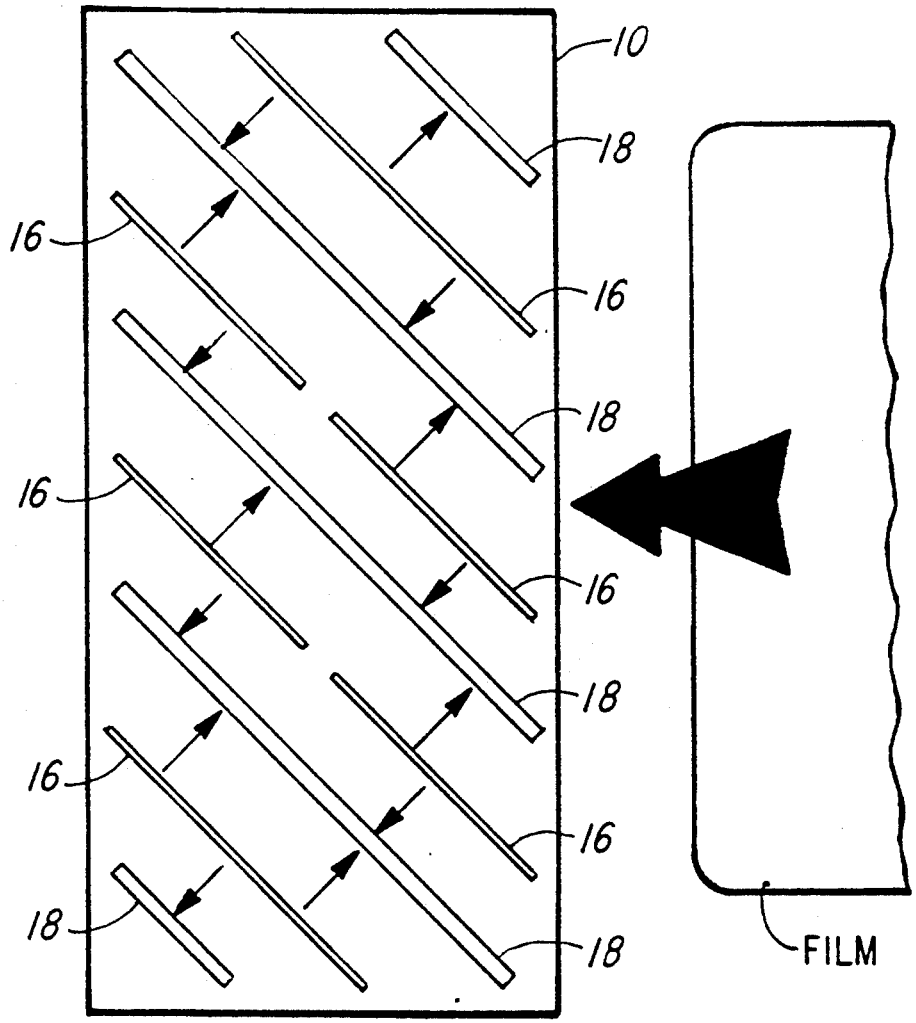
FIG. 6 is a plan view of the injection and evacuation openings with arrows indicating the fluid flow paths.
Figure 7:
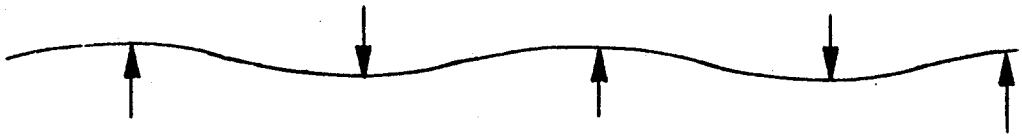
FIG. 7 is a perspective view showing the corrugation of the web while transported through the dryer.

Considering now the angular relationship of the slits 16, 18 with the longitudinal axis of the web, it will be apparent from FIG. 6 that the air flowing from each slit 16 will have two components, one traveling with the web at a 45 degree angle to the longitudinal axis of the web and another traveling in the opposite direction to the first at a 45 degree angle to such axis. This increases film stability by minimizing the lift caused by the flow of air traveling against the direction of film travel. Also, as discussed above, the alternating high and low pressure regions extend angularly across the film and tend to produce a corrugated force pattern as shown in FIG. 7. Because this force pattern is angularly oriented relative to the film it tends to deform the film into a shape that has a higher bending moment that makes it more difficult to deform the film. These conditions coupled with the inherent stability produced by having fluid streams on opposite side of the film results in greater strength, less vibration and greater resistance to bending.

The invention thus effectively adds to the basic stability achieved by having laminar air streams on opposite sides of a web as disclosed in application Ser. No. 07,633,505 (incorporated herein by reference) by providing an angularly oriented force pattern across the web.

Figure 9:
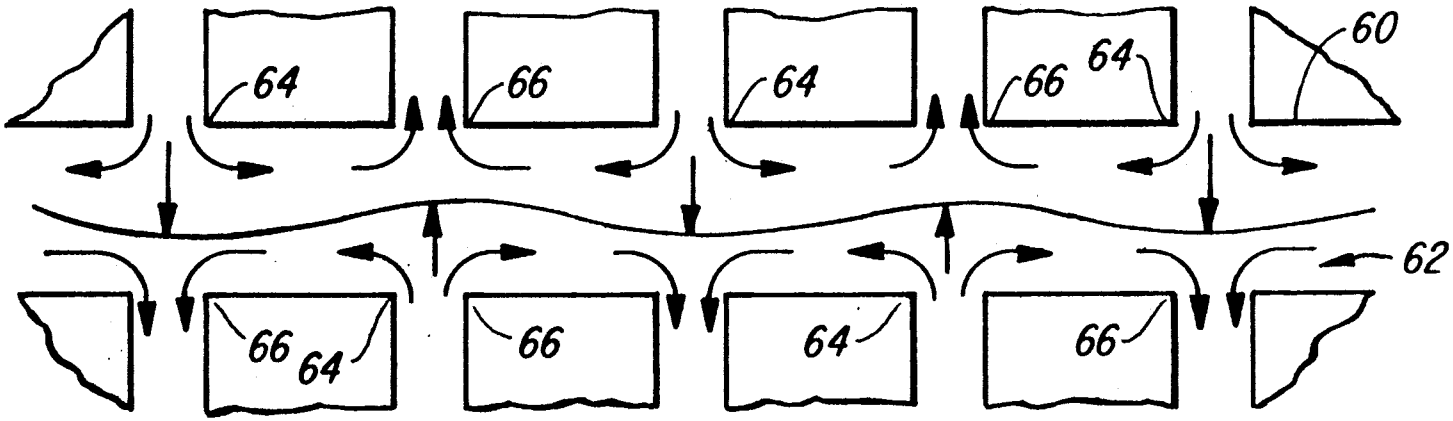
FIG. 9 is a schematic illustration of another embodiment of the invention

Another embodiment of the invention is depicted schematically in FIG. 9. In this embodiment a dryer 60 is provided with a channel 62 having a plurality of injection slits 64 and a plurality of evacuation slits 66 which are shown exaggerated in size. In this embodiment the injection and evacuation slits alternate on each side of the channel as in the previous embodiment.

However, in the case an evacuation slit 66 is always in juxtaposed relationship with an injection slit. This produces a differential force on the film at each site as indicated by the vertical arrows which indicate the force direction. As a result, the film is forced into a physically corrugated configuration as shown. If the slits are angularly oriented relative to the film axis, the physical corrugations will substantially increase the bending resistance of the film.

It will be apparent that the invention disclosed thus greatly improves the stability of a moving web during transport through a fluid treatment channel. The fluid streams on opposite sides of the web tend to support and stabilize the web. The angled orientation of the fluid injection and evacuation openings further stabilize the web by minimizing web lift and producing a corrugated force pattern on the web to increase the strength of the web and reduce web vibration.

Those skilled in the art to which the invention relates will appreciate that various substitutions and modifications can be made to the described embodiment without departing from the spirit and scope of the invention as described by the claims below.

We claim:

1. Apparatus for subjecting a web to treatment fluid, said apparatus comprising:

means defining a fluid treatment channel for receiving the web, said means including a plurality of elongated juxtaposed fluid injection openings on opposite sides of said channel and a plurality of juxtaposed fluid evacuation openings on opposite sides of the channel, said fluid injection openings being angularly oriented with respect to the longitudinal axis of the web; and means for supplying treatment fluid under pressure to said injection openings to inject treatment fluid under pressure into said channel on opposite sides of the web to establish a flow of treatment fluid from said injection openings to said evacuation openings in directions having an angular relationship with the longitudinal axis of the web.

2. Apparatus as claimed in claim 1, wherein said injection openings comprise a plurality of spaced pairs of juxtaposed elongated slits.

3. Apparatus as claimed in claim 2, wherein said evacuation openings comprises a plurality of spaced pairs of juxtaposed elongated slits, each of said pairs of juxtaposed injection slits being located between two adjacent pairs of juxtaposed evacuation slits in spaced relationship therewith.

4. Apparatus as claimed in claim 3, wherein said channel defining means comprises a pair of spaced parallel plates for receiving the web therebetween, each of said pairs of injection slits and each of said pairs of evacuation slits comprising juxtaposed slits in said plates respectively.

5. Apparatus for drying webs of light sensitive material comprising:

means defining a channel for receiving the web, said means including a plurality of elongated spaced injection openings for applying drying fluid to opposite sides of the web and a plurality of elongated spaced evacuation openings for evacuating drying fluid from opposite sides of the web, said injection openings and said evacuation openings being substantially parallel to each other and angularly oriented relative to the longitudinal axis of the web; and means for supplying drying fluid to said injection openings.

6. Apparatus as claimed in claim 5, wherein said injection openings comprise a plurality of spaced pairs of juxtaposed elongated openings on opposite sides of said channel.

7. Apparatus as claimed in claim 6, wherein said evacuation openings comprises a plurality of spaced pairs of juxtaposed elongated openings on opposite sides of said channel, each of said pairs of injection openings being located between two pairs of evacuation openings in spaced relationship therewith.

8. Apparatus as claimed in claim 7, wherein said channel defining means comprises a pair of spaced parallel plates for receiving the web therebetween, each of said pairs of injection openings and each of said pairs of evacuation openings comprising juxtaposed slits in said plates respectively.

9. Apparatus as claimed in claim 8, wherein said means for supplying drying fluid comprises:

housing means defining fluid chambers adjacent said plates on opposite sides thereof; and means for conducting fluid from said chambers to said injection slits.

10. Apparatus as claimed in claim 9, wherein said housing means comprise a pair of housings positioned in spaced relationship with said plates and said fluid conducting means comprise hollow spacers positioned between said housing means and said plates.

11. Apparatus as claimed in claim 10, wherein air is evacuated from said channel through said evacuation slits into the space between said housings and said plates.

12. Apparatus as claimed in claim 5 wherein each of said injection openings is positioned on one side of said channel and in juxtaposed relationship with one of said evacuation openings on the other side of said channel.

13. Apparatus as claimed in claim 12 wherein said channel defining means comprises a pair of spaced parallel plates for receiving the web there between and said injection and evacuation openings comprise elongated slits in said plates.

14. Apparatus as claimed in claim 13 wherein said means for supplying drying fluid comprises:

housing means defining fluid chambers adjacent said plates on opposite sides thereof; and means for conducting fluid from said chambers to said injection slits.

15. Apparatus as claimed in claim 14 wherein said housing means comprise a pair of housings positioned in spaced relationship with said plates and said fluid conducting means comprise hollow spacers positioned between said housing means and said plates.

16. Apparatus as claimed in claim 3 wherein said injection slits are spaced from said evacuation slits by a distance such that fluid is evacuated from said channel when the boundary layer of the drying fluid reaches a predetermined thickness.

17. Apparatus as claimed in claim 15 wherein said injection slits are spaced from said evacuation slits by a distance such that fluid is evacuated from said channel when the boundary layer of the drying fluid reaches a predetermined thickness.

* * * * *